United States Patent [19]

Van Horne et al.

[11] 4,425,046

[45] Jan. 10, 1984

[54] RIBBON CASSETTE AND SENSOR ASSEMBLY

[75] Inventors: Arthur C. Van Horne, Lake Oswego, Oreg.; Terry L. Branson, Dripping Springs, Tex.

[73] Assignee: Dataproducts Corporation, Woodland Hills, Calif.

[21] Appl. No.: 433,738

[22] Filed: Oct. 12, 1982

Related U.S. Application Data

[63] Continuation of Ser. No. 189,122, Sep. 22, 1980, abandoned.

[51] Int. Cl.[3] ..... B41J 35/14; B41J 35/20; B41J 32/00

[52] U.S. Cl. ..... 400/208; 400/212; 400/229

[58] Field of Search ..... 400/174, 175, 144.2, 400/208, 229, 211-213, 195-196

[56] References Cited

U.S. PATENT DOCUMENTS

| | | | |
|---|---|---|---|
| 2,883,029 | 4/1959 | Gray | 400/208 |
| 3,503,483 | 3/1970 | Santo | 400/208 |
| 3,863,749 | 2/1975 | Perry et al. | 400/208 |
| 3,986,594 | 10/1976 | Kondur, Jr. | 400/322 |
| 4,011,934 | 3/1977 | Ploby et al. | 400/212 |
| 4,050,569 | 9/1977 | Crump et al. | 400/124 |
| 4,073,371 | 2/1978 | Prager | 400/212 |
| 4,088,218 | 5/1978 | Depew | 400/208 |
| 4,111,293 | 9/1978 | Kockler et al. | 400/208 |
| 4,132,486 | 1/1979 | Kwan | 400/213 |
| 4,203,677 | 5/1980 | Hatsell | 400/208 |
| 4,280,767 | 7/1981 | Heath | 400/213 |

FOREIGN PATENT DOCUMENTS

| | | | |
|---|---|---|---|
| 2743256 | 4/1979 | Fed. Rep. of Germany | 400/213 |
| 2030076 | 4/1980 | United Kingdom | 400/208 |

OTHER PUBLICATIONS

Kane, "Means Identifying . . . Print wheels," IBM Technical Disclosure Bulletin vol. 22, No. 11, pp. 4795-4796,. 4/80.

Cooper, "Electronic . . . Coding " IBM Technical Disclosure Bulletin vol. 19, No. 11, p. 4242, 4/77.

*Primary Examiner*—William Pieprz

*Attorney, Agent, or Firm*—Spensley, Horn, Jubas, & Lubitz

[57] ABSTRACT

An improved multicolor ribbon cassette system for use with a printing mechanism. A ribbon cassette is carried on a plate which is pivotally connected to a shuttle mechanism. The plate rotates about an axis which is perpendicular to a printing medium and the portion of the ribbon adjacent the printing mechanism. The pivot plate is tilted up or down to position a different part of the ribbon in alignment with a printing mechanism. The configuration of the device is such that the ribbon will remain parallel to the printing medium as it is tilted. The position of the pivot plate is controlled by means of a barrel cam driven by a stepper motor. The stepper motor is controlled by a logic circuit. An optical sensor is also connected to the logic circuit to determine whether a single color or multicolor cassette is in position.

12 Claims, 6 Drawing Figures

RIBBON CASSETTE AND SENSOR ASSEMBLY

This is a continuation of application Ser. No. 189,122, filed Sept. 22, 1980, now abandoned.

BACKGROUND OF THE INVENTION

1. Field of the Invention

This invention relates to a multicolor ribbon assembly for use with a printing mechanism. More particularly, this invention relates to a multicolor ribbon cassette system for use with a matrix printer.

2. Prior Art

In most types of printing mechanisms, ranging from simple typewriters to complex printers, ribbon shifting is accomplished by holding a section of the ribbon in a pivoting bail arm which moves the ribbon up or down to align the correct color band with the printing mechanism such as a print head. The bail arm supports the ribbon in an operating plane which is parallel to a printing medium. One particular arrangement, which is directed to a ribbon cassette with bi-color-capability, is disclosed in U.S. Pat. No. 4,088,218 to Depew. This system, which is specifically designed for use with a matrix print head, includes a body portion having a chamber for storing a ribbon. The ribbon passes around an extension which is pivotal to move the ribbon either up or down with respect to its position within the cassette.

Although a pivotal bail arm is generally satisfactory when only two colors are to be employed, excessive vertical movement of the ribbon can cause snagging and dragging, especially when the ribbon is carried within a cassette. Therefore, it is a primary object of the present invention to provide a ribbon cassette system which provides smooth operation and enables more than two colors to be easily utilized. It is a further object of the present invention to provide a ribbon shifting mechanism which is simple and straightforward. Another object of the present invention is to provide a mechanism which can determine whether or not a cassette is in position and what type of cassette is being used.

SUMMARY OF THE INVENTION

These and other objects are achieved by providing a system in which the entire ribbon cassette is pivoted about an axis perpendicular to the printing medium. In contrast to prior art systems, the shifting of the ribbon is accomplished by pivotal motion of the cassette rather than translational motion of the ribbon. Movement of the entire ribbon assembly eliminates any kind of snagging of the ribbon. Although the entire ribbon cassette is moved in order to change colors, the mechanism by which this is accomplished is extremely simple.

The system is particularly useful in conjunction with a matrix printer which includes a print head that is carried on a shuttle mechanism. Other printers which can utilize the invention include ball and daisy wheel types. A pivot plate has one end secured to the shuttle so as to enable the pivot plate to rotate about an axis which is perpendicular to both the printing medium and the portion of the ribbon which is in a printing position. A ribbon cassette is detachably mounted on the pivot plate. A ribbon drive motor is secured to the underside of the pivot plate and advances the ribbon within the cassette. By pivoting the pivot plate, different portions of the ribbon carried in the cassette will be positioned adjacent the print head. However, since the ribbon is pivoting about an axis perpendicular to the printing medium, it will remain parallel to the printing medium as it is moved.

The movement of the pivot plate is controlled by means of a barrel cam which is driven by a stepper motor. The barrel cam and the stepper motor are attached to the shuttle, and the cam is coupled to the pivot plate by means of a cam follower. The position of the cam is controlled by a suitable logic circuit. Other types of positioning arrangements, such as a movable ramp, may also be utilized. The cam arrangement, however, provides a simple means of accurately positioning the ribbon cassette with respect to the print head.

DETAILED DESCRIPTION OF THE DRAWINGS

Figure 1:
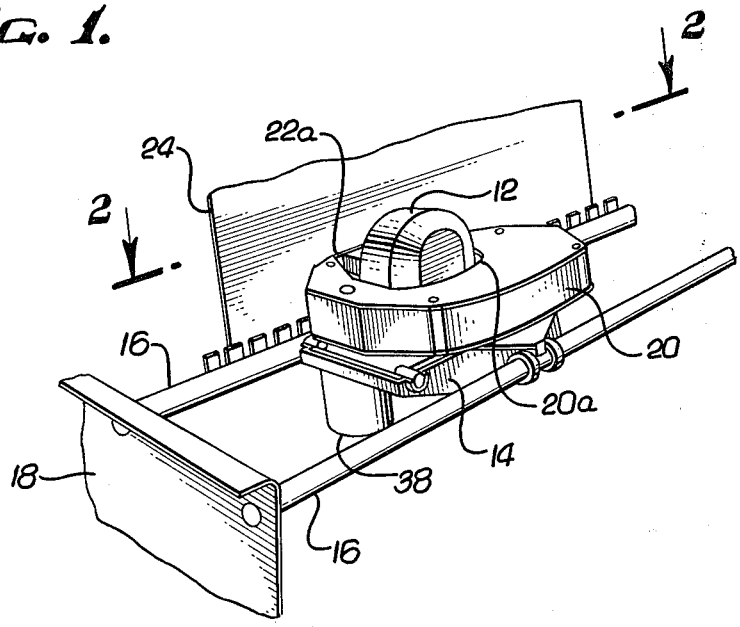
FIG. 1 is a perspective view of a portion of a printer assembly showing the multicolor ribbon cassette system of the present invention in a lowered position.
Figure 6:
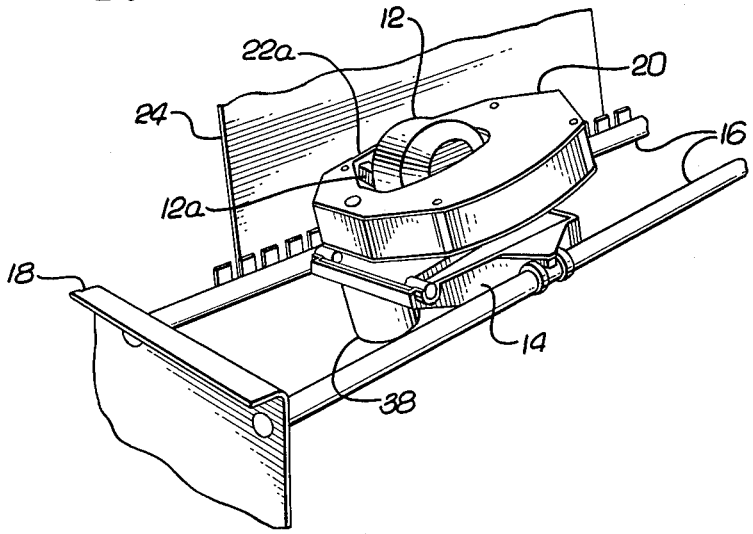
FIG. 6 is a perspective view of a portion of a printer assembly showing the ribbon cassette system in a varied position.

Referring to FIGS. 1 and 6, a printer 10 is shown having a wire matrix print head 12 carried on a shuttle mechanism 14. The print head 12 is biased against a front portion 14*a* of the shuttle. The shuttle moves along a pair of rails 16 which are attached to a frame 18. A ribbon cassette 20 is carried on the shuttle and includes an opening 20*a* through which the print head 12 extends. The ribbon cassette 20 carries a ribbon 22, an exposed portion of which (22*a*) is carried in front of the print head and is substantially parallel to a printing medium 24.

Figure 2:
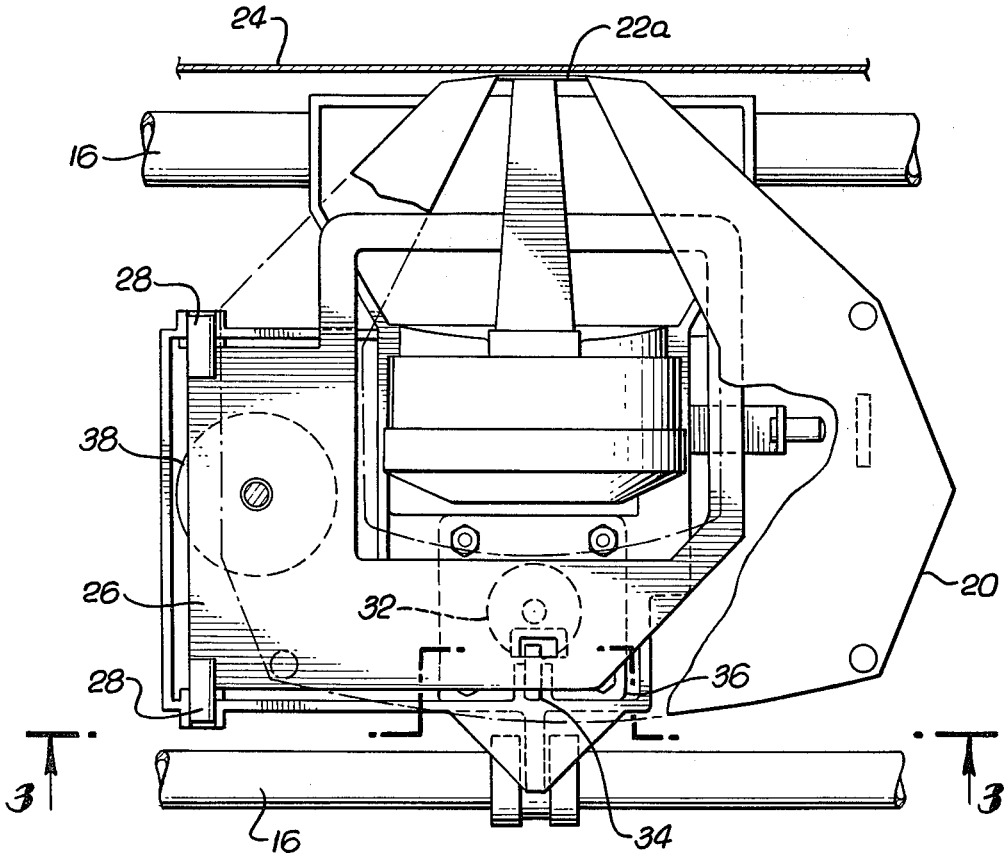
FIG. 2 is a top plan view of the ribbon cassette of the present invention.
Figure 3:
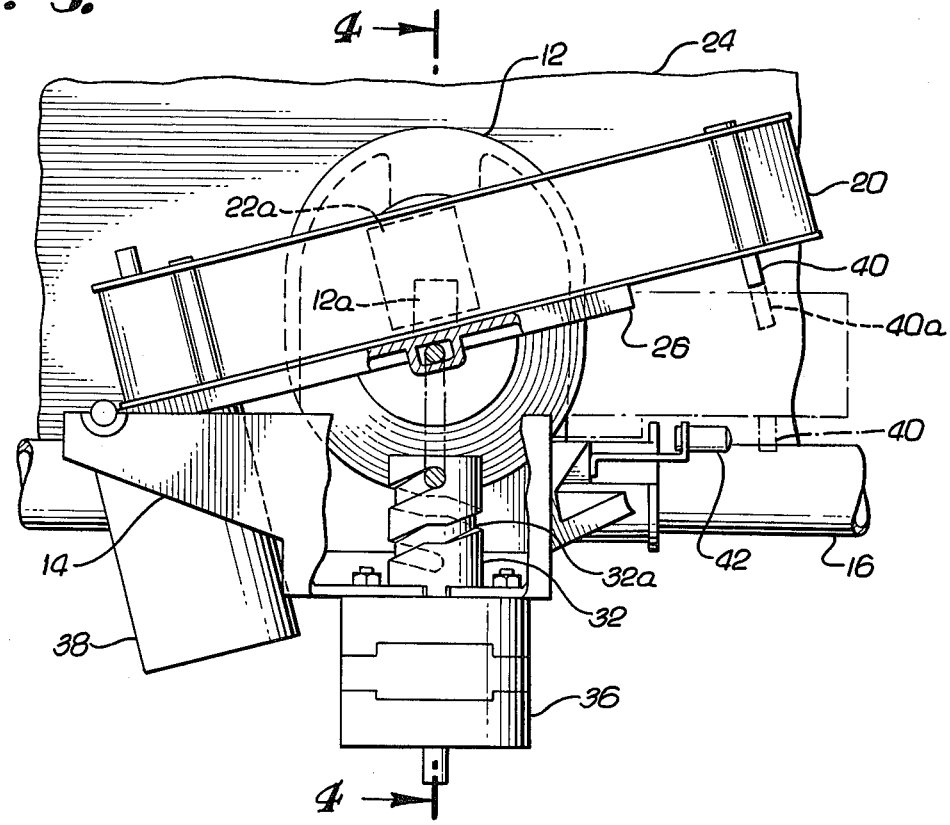
FIG. 3 is a rear plan view of the multicolor ribbon cassette system of the present invention.
Figure 4:
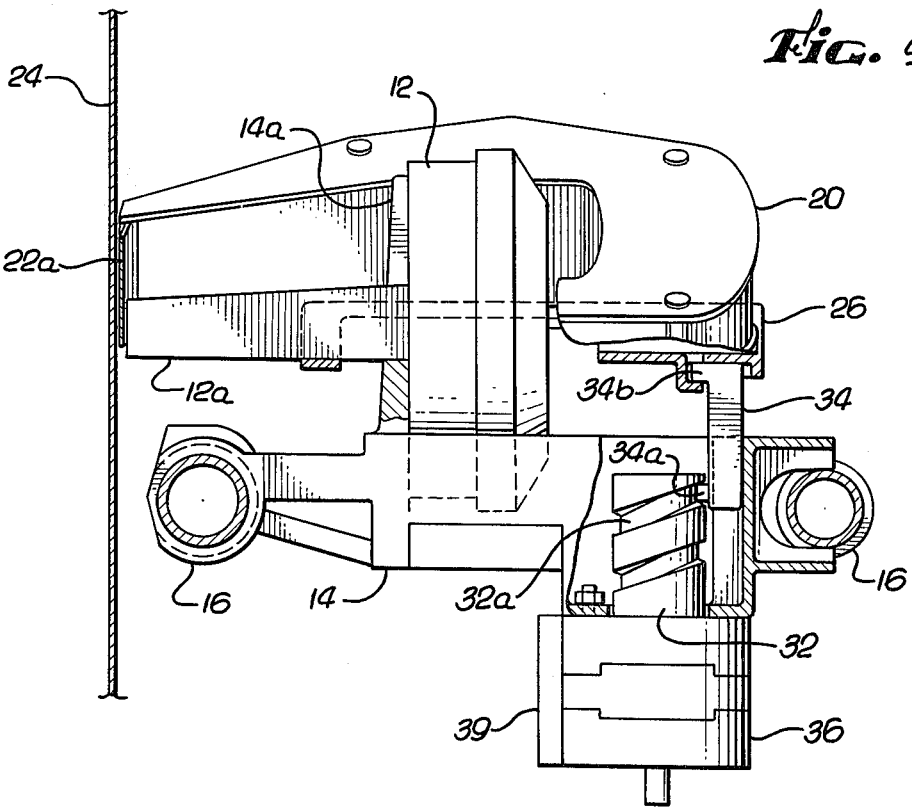
FIG. 4 is a side plan view of the multicolor ribbon cassette system of the present invention.

Referring now to FIGS. 2, 3 and 4, the ribbon cassette 20 is detachably connected to a pivot plate 26 which serves to position the ribbon cassette 20 with respect to the print head 12. The pivot plate 26 is pivotally connected to the shuttle 14 by means of a pair of hinges 28 which enable the pivot plate 26 to rotate about an axis which is perpendicular to the printing medium 24 and ribbon porton 22*a*. Because of this configuration, the ribbon portion 22*a* will will remain parallel to the printing medium 24 as the pivot plate 26 and the ribbon cassette 20 are pivoted. The pivoting of the pivot plate 26 will align a different portion of the height of the ribbon portion 22*a* with the front 12*a* of the print head. The ribbon 22 is advanced by means of a ribbon drive motor 38 which is connected to the underside of the pivot plate 26. This enables the ribbon 22 to be advanced within the cassette 20 even when the pivot plate 26 is in a tilted position. It should be noted that the tilting of the cassette 20 will not impair the printing action of the printer. At all times, the ribbon portion 22*a* will be parallel to both the front of the print head 12 and the printing medium 24.

Figure 5:
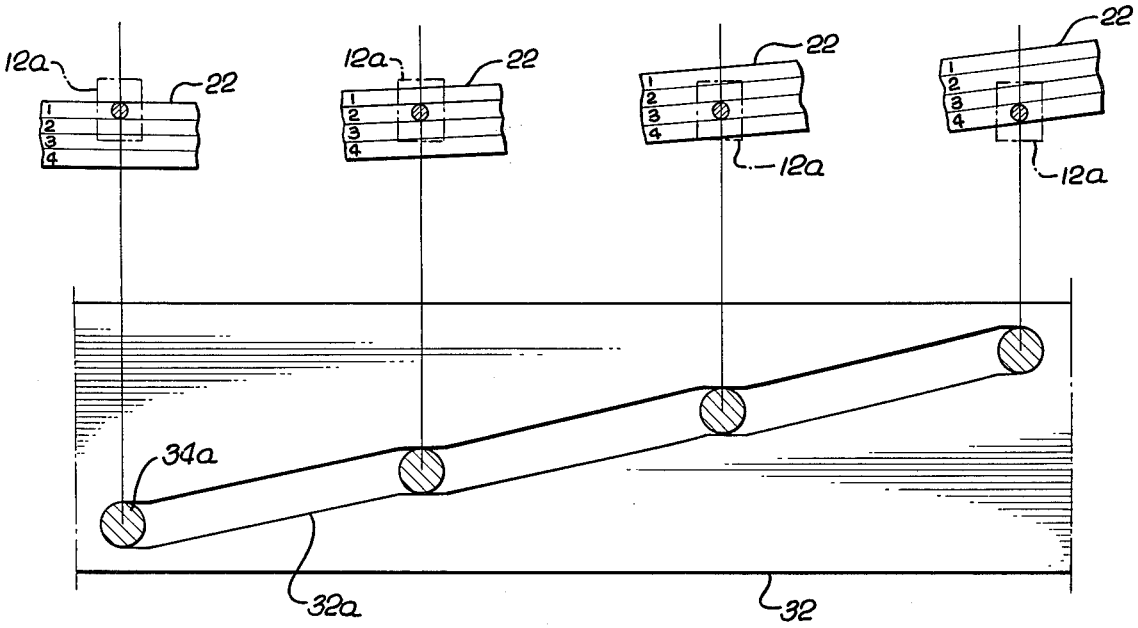
FIG. 5 is a plan view of the track of a cam used to control the position of a ribbon cassette, showing the orientation of a ribbon corresponding to each position of the cam.

The position of the pivot plate 26 is controlled by means of a barrel cam 32 which is attached to the shuttle 14. The barrel cam is driven by a motor 36 and is coupled to the pivot plate 26 by means of a bar shaped cam follower 34. The cam 32 includes a substantially spiral groove 32*a* having four flat rest positions which serve to define four distinct printing positions (FIG. 5) for the ribbon cassette 20. The cam follower includes a protrusion 34*a* which cooperates with the spiral groove 32*a* and a protrusion 34*b* which extends into a notch 26*a* in the pivot plate. The motor 36, which is a stepper motor in the present embodiment of the invention, operates to rotate the cam 32 so that the cam follower portion 34*a* is positioned in one of the four flat portions of the spiral groove 32*a*. The flat portions enable accurate ribbon height positioning to be achieved despite slight inaccuracies in motor position, and also prevents rotation of the cam 32 which would otherwise be caused by the application of downward force on the cassette 20. The motor 36 is controlled by a suitable logic circuit 39. In the present embodiment of the invention, the logic circuit 39 is such that when power is first applied to the printer 10, the stepper motor 36 is commanded to bring the cassette 20 down to the horizontal position by shifting the cam follower 34 down four times. If the cassette 20 is already down or partially down, the motor 36 simply stalls for all or some of the four shift commands. Once this initializing process has been completed, the logic circuit 39 knows that the cassette is on band one of the ribbon 22 and keeps track of the position of the cassette as long as the power remains on. The positions of a four band ribbon 22 with respect to the front of the printhead 12*a* corresponding to different positions of the cam 32 are shown in FIG. 5. When the ribbon cassette 20 is horizontal, band 1 of the ribbon 22 is aligned with the printhead 12*a*, while when the cassette 20 is tilted fully upward, band 4 of the ribbon 22 is aligned with the printhead 12*a*.

In the present embodiment of the invention, two different types of ribbon cassettes can be employed. The first type includes four separate color bands to provide four color printing capability. The second type includes an all black (or other single color) ribbon. Both types of cassettes utilize a ribbon having the same width (one inch). In order to automatically determine what type of cassette is installed in the printer, a two step process is utilized. Each ribbon cassette includes a projection or fin 40 extending from the bottom surface of the cassette. When the pivot plate is in its horizontal position, the projection 40 on either cassette is detected by means of an optical sensor 42 located on the shuttle 14. After it has been determined that a ribbon cassette is in place, the pivot plate is shifted up two positions and the sensor 42 again activated. The length of the projection 40 on a cassette having a four color ribbon is shorter than that on a cassette having a single color ribbon. The length of a single color projection is shown in FIG. 3 by a dashed line 40*a*. When the pivot plate is in a raised position, the sensor 42 will detect only the longer of the two projections. The logic circuit 39 receives information from the sensor 42 in order to determine the presence and type of cassette being used.

In summary, the present invention is directed to a simple and effective way of utilizing a multicolor ribbon cassette in a printing mechanism. Although the invention has been described in terms of use with a matrix printer, it could easily be adapted for use with other types of printers. By shifting the position of the entire cassette instead of simply moving a portion of the ribbon, installation of a cassette is a very simple procedure, since nothing special has to be done with the ribbon (i.e., threading into a bail arm ). Although the shifting has been described in terms of the tilting of a ribbon cassette, a system could employ a shift mechanism which maintains the cassette in a horizontal orientation and shifts the entire cassette vertically in order to properly align the ribbon with the printhead. The system can easily handle more than two colors despite the large distance between the plural color tracks. In addition, the system provides for more accurate positioning than do typical bail systems.

Although the invention has been described in terms of a single embodiment, it should be recognized that modifications and variations will readily occur to those skilled in the art. For example, many alternate methods could be utilized to actuate and position the pivot plate, including use of a rotating bar, solenoids or a cable instead of a stepper motor or the use of a linear wedge ramp instead of a barrel cam. Consequently, it is intended that the claims be interpreted to cover such modifications and equivalents.

What is claimed is:

1. A multiposition ribbon cassette system for positioning a ribbon having two or more printing bands with respect to the printhead of a printer or the like, comprising:

a shuttle which is adapted to carry a printhead across a printing medium; and means, coupled to said shuttle and movable in conjunction with the printhead, for (a) supporting a ribbon cassette having a ribbon therein, said ribbon cassette carrying a portion of said ribbon in a plane parallel to the printing medium, and (b) shifting said ribbon cassette to a plurality of fixed positions to shift the entire ribbon cassette so as to change the vertical position of the ribbon cassette with respect to the printhead to position a different print band adjacent head while maintaining the ribbon parallel to and a constant distance from the printing medium.

2. A multiposition ribbon cassette system for positioning a ribbon having two or more printing bands with respect to the printhead of a printer or the like, comprising:

a shuttle which is adapted to carry a printhead across a printing medium; and means, coupled to said shuttle and movable in conjunction with the printhead, for supporting a ribbon cassette having a ribbon therein, said ribbon cassette carrying a portion of said ribbon in a plane parallel to the printing medium, wherein said means for supporting are movable to a plurality of fixed positions to change the vertical position of the ribbon cassette with respect to the printhead while maintaining the ribbon parallel to the printing medium, wherein in each of said fixed positions a different printing band is positioned adjacent the printhead, wherein the means for supporting are pivotal about an axis perpendicular to said plane and printing medium, whereby the ribbon cassette is tilted in order to change the position of the printing bands of the ribbon with respect to the printhead.

3. The system of claim 2 wherein the means for supporting comprises a pivot plate pivotally secured to the shuttle, wherein said pivot plate is pivotal about said axis.

4. The system of claim 3 further comprising a ribbon drive motor attached to the pivot plate, said ribbon drive motor coupling to a ribbon cassette and operable to advance the ribbon in the cassette.

5. The system of claim 3 further including a multiposition cam coupled to the pivot plate, said cam being movable to position the pivot plate in one of a plurality of locations corresponding to the fixed positions of the ribbon.

6. The system of claim 5 wherein said cam is mounted on said shuttle and further including:

a cam motor attached to the shuttle for controlling the position of the cam; and a cam follower connecting the cam to the pivot plate.

7. The system of claim 6 wherein said cam is cylindrical and includes a substantially spiral slot on its outer surface and wherein said cam follower comprises a rod coupled to said slot.

8. The system of claim 7 wherein the slot includes a plurality of flat portions, one corresponding to each of the fixed positions of the ribbon, said flat portions facilitating accurate ribbon positioning.

9. The system of claim 6 wherein said cam motor is a stepper motor.

10. The system of claim 3 further including an optical sensor for detecting the presence of a fin located on each ribbon cassette.

11. The system of claim 10 wherein the configuration of said fin is a function of one of two types of ribbon carried within the ribbon cassette and wherein said sensor is such that when the pivot plate is in a first position either configuration of said fin will be detected and when the pivot plate is in a second position only one configuration will be detected, thereby facilitating determination of the type of ribbon carried within the ribbon cassette.

12. In a printer or the like having a printhead which traverses a printing medium, a multiposition ribbon cassette system for positioning one of a plurality of printing bands of a ribbon with respect to the printhead, comprising:

a shuttle which is adapted to carry the printhead perpendicular to and across the printing medium;

a pivot plate located on the shuttle having one end pivotally secured to the shuttle along an axis perpendicular to the printing medium;

a cam motor secured to the shuttle;

a cam attached to the cam motor and movable to a plurality of predetermined fixed positions;

a cam follower connected between the cam and the pivot plate; and a ribbon cassette detachably connected to the pivot plate and housing a ribbon having plural printing bands, wherein a portion of said ribbon is carried parallel to the printing medium;

whereby movement of said cam will cause said pivot plate to pivot up or down, thereby changing the position of the ribbon cassette to a position a different printing band with respect to the printhead while maintaining the ribbon in a plane parallel to the printing medium.

* * * * *